US005646383A

United States Patent [19]

Deem

[11] Patent Number: 5,646,383

[45] Date of Patent: Jul. 8, 1997

[54] CHRISTMAS TREE ORNAMENT POWER SWITCH

[76] Inventor: David Lloyd Deem, 8801 Hunters Lake Dr., Apt. 622, Tampa, Fla. 33647

[21] Appl. No.: 442,325

[22] Filed: May 16, 1995

[51] Int. Cl.[6] ..... H01H 35/00

[52] U.S. Cl. ..... 200/52 R; 362/806

[58] Field of Search ..... 200/52 R; 362/806; 315/53; 439/651, 502, 503, 105

[56] References Cited

U.S. PATENT DOCUMENTS

| | | | |
|---|---|---|---|
| Re. 34,717 | 9/1994 | Sanders et al. | 362/806 X |
| D. 307,579 | 5/1990 | Layne et al. | D13/140 |
| 1,894,112 | 1/1933 | McNeil | D13/140 |
| 2,763,744 | 9/1956 | Sternburgh | 200/61.52 |
| 2,907,855 | 10/1959 | Hedges | D13/140 |
| 3,161,738 | 12/1964 | Hall | 200/61.52 |
| 3,873,880 | 3/1975 | Riddell | 315/53 |
| 4,073,564 | 2/1978 | Davis, Jr. | 439/651 |
| 4,652,980 | 3/1987 | Segan | 362/806 X |
| 4,923,721 | 5/1990 | Gilmore | 362/806 X |
| 4,985,883 | 1/1991 | Hou | 446/299 |
| 4,989,120 | 1/1991 | Davis et al. | 362/806 X |
| 5,470,239 | 11/1995 | Rancourt | 439/105 |

*Primary Examiner*—J. R. Scott

*Attorney, Agent, or Firm*—Patent & Trademark Services; Joseph H. McGlynn

[57] ABSTRACT

A Christmas tree switch for controlling the lights on a Christmas tree is placed into a Christmas tree ornament. The ornament can be hung in a convenient location any where on the tree and will provide a convenient way of turning the tree lights on and off.

1 Claim, 1 Drawing Sheet

CHRISTMAS TREE ORNAMENT POWER SWITCH

BACKGROUND OF THE INVENTION

This invention relates in general to a switch and in particular to a switch contained within an ornament adapted to hang on a Christmas tree.

DESCRIPTION OF THE PRIOR ART

In the prior art various switches have been used to turn on and off Christmas tree lights. However all of the prior art switches have been switchs that are inserted into an extension cord into which the tree lights have been plugged. This sometimes places the switch in a location that is difficult to reach when a person wishes to turn the lights on and off.

SUMMARY OF THE INVENTION

The present invention places a switch inside a Christmas tree ornament which can be hung on the tree in a convenient location. Then when a person wishes to turn the lights on or off, the switch is easily accessible.

It is an object of the present invention to place a switch for Christmas tree lights in an easily accessible location on a Christmas tree.

It is an object of the present invention to provide a switch which will not distract from the appearance of a decorated Christmas tree.

It is an object of the present invention to provide an inexpensive power switch for a Christmas tree.

These and other objects and advantages of the present invention will be fully apparent from the following description, when taken in connection with the annexed drawings.

DESCRIPTION OF THE PREFERRED EMBODIMENT

Figure 1:
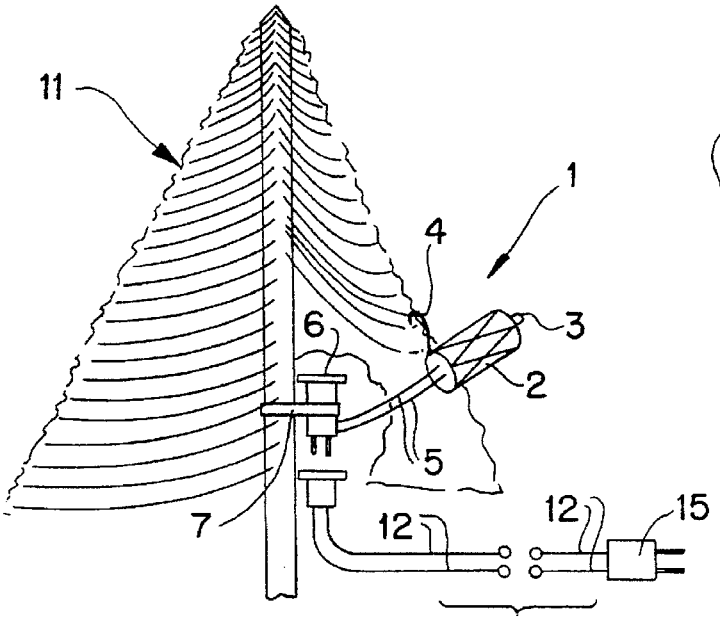
FIG. 1 is a view of the Christmas tree ornament switch attached to a Christmas tree.
Figure 2:
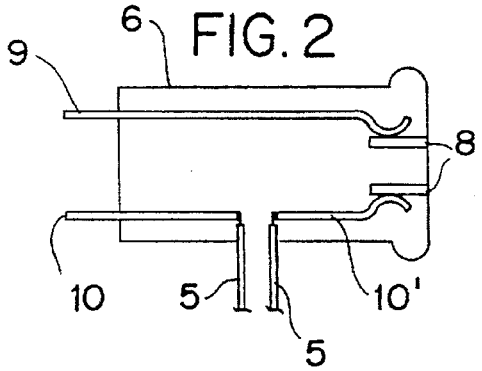
FIG. 2 is a cut away view showing the inside of the plug attached to the switch.
Figure 3:
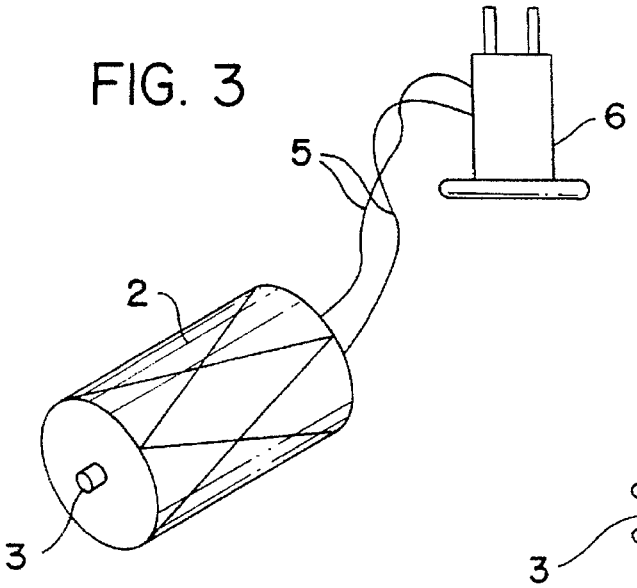
FIG. 3 is a view of the ornament with the switch attached to the plug.
Figure 4:
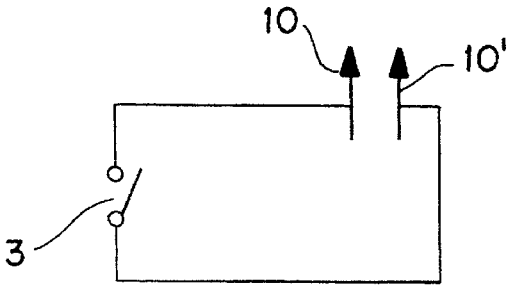
FIG. 4 is a circuit diagram of the switch.

Referring to the drawings, FIG. 1 shows the Christmas tree ornament switch 1 attached to a Christmas tree 11. Although the plug 6 is shown attached to the trunk of the tree by a band 7, it should be noted that the location is not critical and any convenient location may be chosen by the user. The present invention consists of a Christmas tree ornament 2 which may be hung on one of the branches of the tree by a conventional tree hook 4. In FIG. 1 an ornament 2 shaped like a drum is illustrated, however, the specific type of ornament is not material to the present invention, and any type of ornament can be used. A switch 3 is incorporated into the ornament and is connected by electrical wires 5 to a plug 6. The plug 6 has female contacts 8 at one end and male contacts 9 and 10 at the other end. The contact 10 is split into two parts, 10 and 10', as shown in FIG. 2, and an electrical wire is connected to each of the parts of the contact 10. One of these wires leads to one pole of switch 3, and the other leads to the other pole of switch 3, as shown schematically in FIG. 4.

The male contacts 9 and 10 can be plugged into a conventional extension cord 12, shown in FIG. 1, and the extension cord will be plugged into a conventional outlet, by means of a conventional plug 15, to supply electrical power to the switch 3. The extension cord 12 is shown as separated in FIG. 1 to indicated that it can be of any length. It should also be noted that any type of switch can be used with the present invention. For example, a slide switch, a pivoted switch or a rotary switch, or any other conventional switch could be used with the same results.

In order to use the ornament switch, a convenient location on the tree, that is one that is easy to reach, is selected and the ornament is hung on the tree using a conventional tree hook. Then the plug 6 is attached to the tree. This can be accomplished by using a band which has Velcro attachments or any conventional attachment can be used. The Christmas tree lights are plugged into the contacts 8 on the plug 6. An extension cord 12 is plugged onto the male contacts 9 and 10 of plug 6, and the extension cord is then connected to a conventional wall outlet. Now, whenever a person wants to turn the tree lights on or off, he merely has to turn the switch 3 which is mounted at a convenient location on the tree.

Although the Christmas tree ornament switch and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A device for controlling lights on a Christmas tree comprising:

plug means for connecting said lights to a source of electrical power, ornament means for being attached to a Christmas tree, switch means mounted inside said ornament means for turning electrical power to said plug means on and off, means for turning said switch means on and off, electrical wires connected at one end to said switch means and connected at another end to said plug means, said plug means being separate and distinct from said switch means and being connected to said switch means only by said electrical wires, said plug means having female contact means at one end for receiving a plug attached to at least one set of Christmas tree lights, and said plug means has male contact means at another end for engagement with a source of electrical power.

* * * * *